US007914625B2

(12) United States Patent
Bertsch et al.

(10) Patent No.: US 7,914,625 B2
(45) Date of Patent: Mar. 29, 2011

(54) SEQUENCING DIVERTER VALVE SYSTEM FOR AN APPLIANCE

(75) Inventors: Roger James Bertsch, Stevensville, MI (US); Bruce W. Gillum, Kalamazoo, MI (US); Donald Joseph Wilson, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 332 days.

(21) Appl. No.: 12/193,806

(22) Filed: Aug. 19, 2008

(65) Prior Publication Data

US 2010/0043825 A1 Feb. 25, 2010

(51) Int. Cl.
*B08B 3/02* (2006.01)

(52) U.S. Cl. ..... 134/25.2; 134/179; 134/176; 134/36

(58) Field of Classification Search ..... 134/176, 134/179; 137/625.15, 625.16, 625.22; 239/251
See application file for complete search history.

(56) References Cited

U.S. PATENT DOCUMENTS

| | | | | | |
|---|---|---|---|---|---|
| 2,075,702 | A | * | 3/1937 | Coles et al. | 239/244 |
| 2,459,244 | A | * | 1/1949 | Sellars | 239/244 |
| 2,673,761 | A | * | 3/1954 | Karlstrom | 239/231 |
| 2,963,029 | A | * | 12/1960 | Bock | 134/58 R |
| 3,060,946 | A | * | 10/1962 | Lantz | 134/112 |
| 3,115,306 | A | * | 12/1963 | Graham | 239/243 |
| 3,538,927 | A | * | 11/1970 | Wallgren | 134/144 |
| 3,876,148 | A | | 4/1975 | Cushing et al. | |
| 4,244,524 | A | | 1/1981 | Wellings | |
| 5,579,789 | A | | 12/1996 | Spiegel | |
| 5,848,610 | A | | 12/1998 | Livernash et al. | |
| 6,601,593 | B2 | * | 8/2003 | Deiss et al. | 134/25.2 |
| 7,100,623 | B2 | * | 9/2006 | Assmann et al. | 134/184 |
| 7,614,408 | B2 | * | 11/2009 | Park et al. | 134/56 D |
| 2005/0011544 | A1 | | 1/2005 | Rosenbauer et al. | |

FOREIGN PATENT DOCUMENTS

| | | | |
|---|---|---|---|
| JP | 2000-197857 | * | 7/2000 |
| JP | 2007-125154 | * | 5/2007 |

* cited by examiner

*Primary Examiner* — Frankie L Stinson
(74) *Attorney, Agent, or Firm* — Robert A. Bacon; Diederiks & Whitelaw PLC

(57) ABSTRACT

A sequencing diverter valve system in a washing appliance includes a fluid distribution manifold having a fluid inlet for receiving washing fluid and a plurality of fluid outlets. A fluid responsive rotating drive arm is connected to a drive reduction mechanism which, in turn, is operatively connected to a rotating sequencing valve for shifting the valve through a plurality of discrete positions at a rate of rotation less than the rate of rotation of the drive arm. As it rotates, the sequencing valve sequentially directs the washing fluid to a respective one or more of the plurality of fluid outlets.

20 Claims, 6 Drawing Sheets

SEQUENCING DIVERTER VALVE SYSTEM FOR AN APPLIANCE

BACKGROUND OF THE INVENTION

1. Field of the Invention

The present invention pertains to the art of valve systems for appliances and, more specifically, to a diverter valve system for selectively supplying washing fluid in an appliance.

2. Description of the Related Art

Washing appliances, particularly dishwashers, are provided with internal spraying devices for directing streams of washing liquid at objects to be washed. More specifically, a dishwasher includes a washing chamber having a bottom sump in fluid communication with a motor driven pump to supply washing liquid under pressure to a spraying device that directs streams of washing liquid at dishes held in the washing chamber. As is known, the streams of washing liquid generally flow from one or more rotatable wash arms due to the effect of reactions caused by fluid jets coming out of respective pressure nozzles. It is also known to provide a dishwasher with fixed spray nozzle units.

Typically, the number of spray arms fed by a pump is limited by available water pressure in the dishwasher system. A drop in pressure within the system may reduce the intensity of the water jets, thus reducing cleaning power. Additionally, effective washing at the corners of a square wash rack is difficult to accomplish with standard spray arm configurations. In one proposed solution set forth in U.S. Patent Application Publication No. 2005/0011544, a dishwasher system allows a user to select particular quadrants of the dishwasher for more intense washing. More specifically, a control selectively operates a valve to block fluid to selected spray arms. Additionally, the speed of the circulating pump motor may be changed, thus altering the exit rate of water jets. However, such a system requires specific controls, and multiple supply lines to respective spray arms. Further, the rate of travel for a particular rotating arm is generally dictated by the pressure of the water jets issuing from the arms. Therefore, increasing the speed of the circulating pump not only increases water jet intensity, but reduces the dwell time, or the time water is impinging on articles in the dishwasher. Conversely, reducing the speed of the circulating pump decreases water jet intensity, but increases dwell time.

In any case, there is considered to be a need in the art for a dishwasher system having multiple wash arms for effective cleaning throughout a dishwasher, wherein the system allows for zone washing without sacrificing jet intensity or dwell time.

SUMMARY OF THE INVENTION

The present invention is directed to a washing appliance, such as a dishwasher or clothes washing machine, including a sequencing diverter valve system. In general, the sequencing diverter valve system includes a reduction train and a fluid distribution manifold having a plurality of fluid inlets therein for receiving washing fluid and a plurality of fluid outlets in communication with a plurality of respective spray assemblies, such as rotating spray arms. A fluid responsive rotating drive arm in communication with the fluid distribution manifold has a drive shaft operatively coupled to the reduction train. As the drive arm rotates, a rotational force is transferred to the reduction train by the drive shaft. The drive train includes a gear train, preferably a epicyclical gear train, having an output shaft operatively connected to a rotating sequencing disk to drive the sequencing disk through a plurality of discrete valve positions at a rate of rotation less than the rate of rotation of the drive shaft. As it rotates, the sequencing disk sequentially blocks at least one of the fluid inlets while allowing at least one of the fluid inlets to remain open and transfer washing fluid to an associated spray assembly. The number of spray assemblies that receive washing fluid at any given time is thus dictated by the rotational position of the sequencing disk. In this manner, the sequencing diverter valve system provides increased jet intensity by limiting the number of spray assemblies which operate at one time, without sacrificing dwell time.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
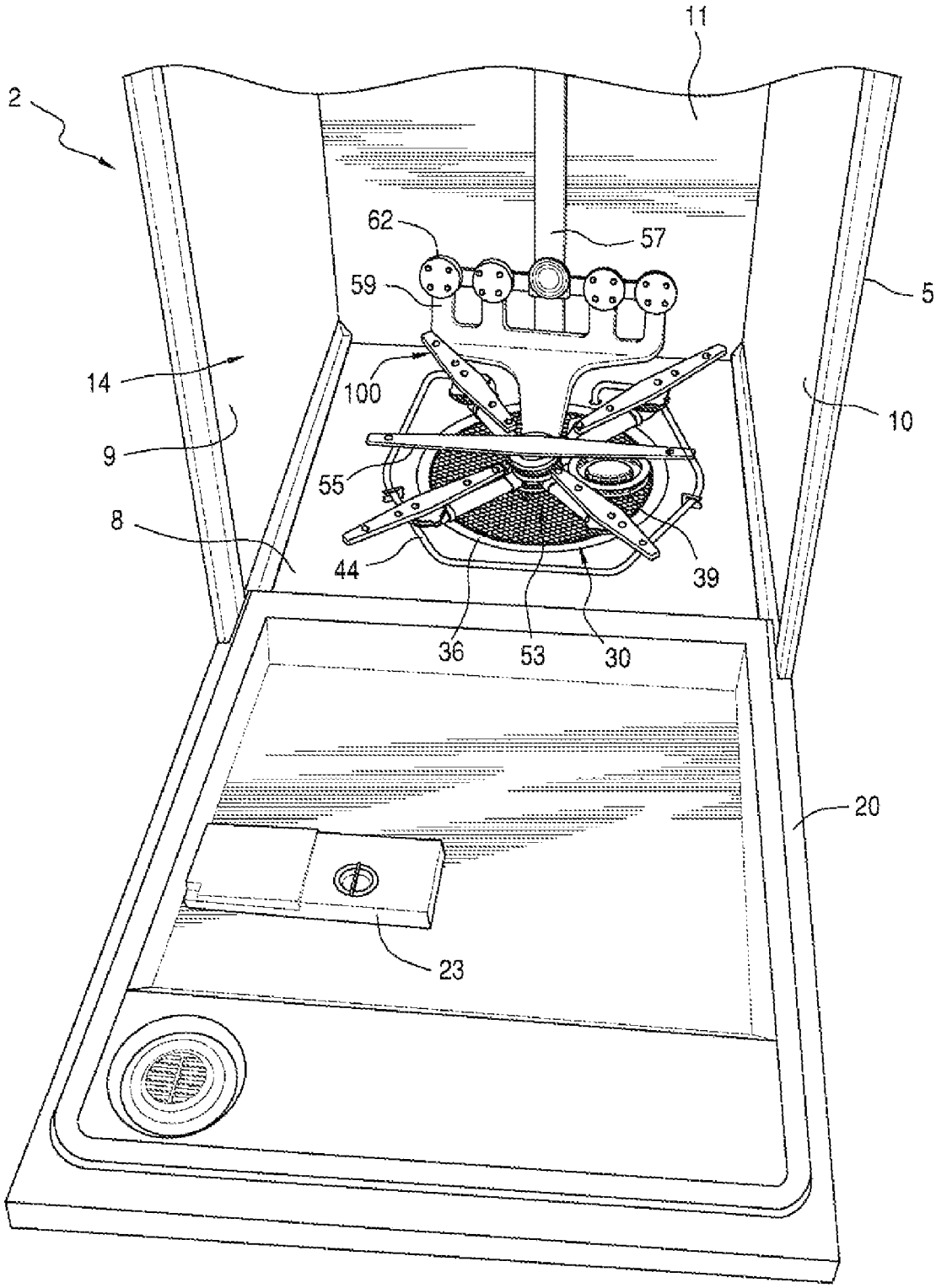
FIG. 1 is a partial perspective view of a dishwasher including a sequencing spray arm assembly constructed in accordance with the present invention.
Figure 2:
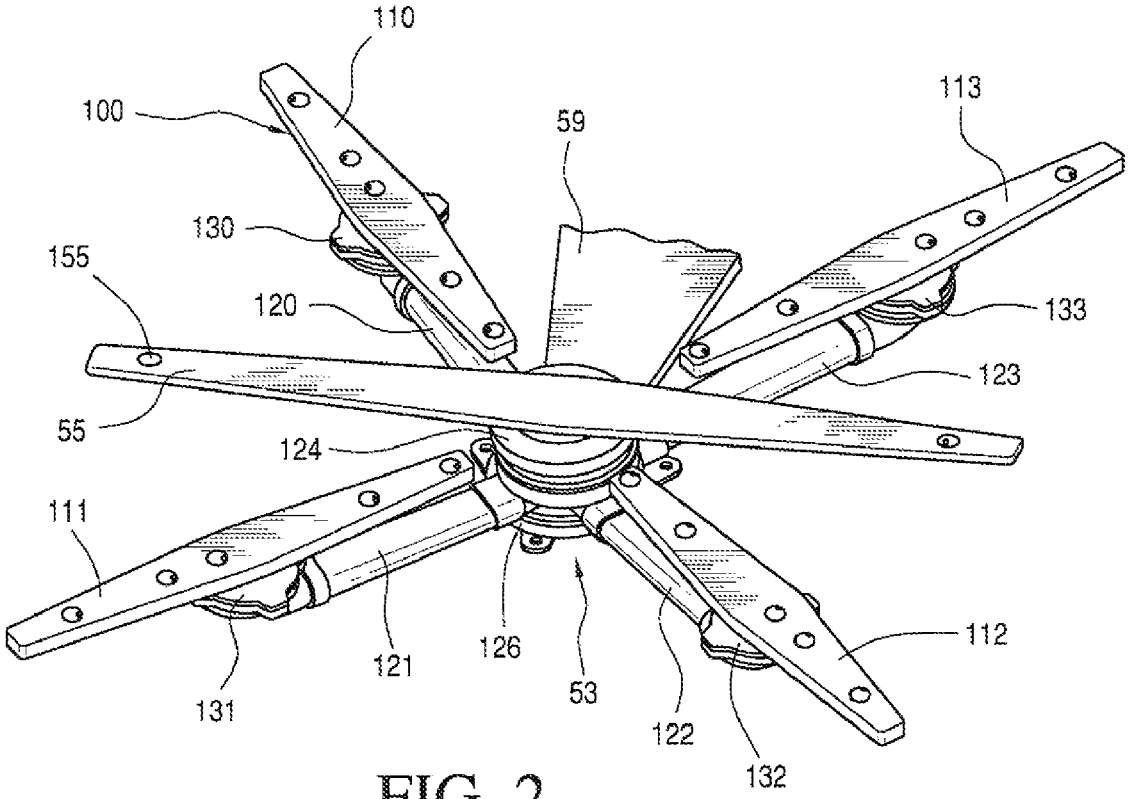
FIG. 2 is a perspective view of the sequencing spray arm assembly of FIG. 1.

With initial reference to FIGS. 1 and 2, a dishwasher constructed in accordance with the present invention as generally indicated at 2. As shown, dishwasher 2 includes a tub 5 which is preferably molded of plastic so as to include integral bottom, side, and rear walls 8-11 respectively, as well as a top wall (not shown). Tub 5 defines a washing chamber 14 within which soiled kitchenware is adapted to be placed upon shiftable upper and lower racks (not shown for drawing clarity), with the kitchenware being cleaned during a washing operation. Tub 5 has attached thereto a pivotally supported door 20 used to seal chamber 14 during the washing operation. In connection with the washing operation, door 20 is preferably provided with a detergent tray assembly 23 within which a consumer can place liquid or particulate washing detergent for dispensing at predetermined portions of the washing operation. Of course, dispensing detergent in this fashion is known in the art such that this arrangement is only being described for the sake of completeness.

Disposed within tub 5 is a filtration system generally indicated at 30. In the preferred embodiment, filtration system 30 includes a central main strainer or filter screen 36 and a secondary strainer 39. Extending about a substantial portion of filtration system 30, at a position raised above bottom wall 8, is a heating element 44. In a manner known in the art, heating element 44 preferably takes the form of a sheath, electric resistance-type heating element.

Dishwasher 2 further includes a fluid distribution system including a circulation pump (not shown) adapted to direct washing fluid from a sump unit (not shown) to a fluid distribution manifold indicated at 53 in a manner known in the art. Fluid distribution manifold 53 supplies washing fluid to a fluid response rotatable drive arm 55 and a conduit 57 leading to at least one upper spray unit (not shown). In a manner known in the art, conduit 57 may supply washing fluid to one or more upper spray assemblies (not shown). Additionally, fluid distribution manifold 53 may be in fluid communication with a spray manifold assembly 59 including a plurality of rotating spray disks 62. Although the above description of dishwasher 2 was provided for completeness, the present invention is particularly directed to a sequencing diverter valve system 102 for use with a spray assembly such as a sequencing spray arm assembly 100 as will now be described in more detail below.

As best seen in FIG. 2, sequencing fluid distribution or spray arm assembly 100 includes first, second, third and fourth fluid propelled rotating spray arms 110-113 in fluid communication with fluid distribution manifold 53 via respective radially extending and circumferentially spaced elongated carrier arms 120-123. Drive arm 55 is rotatably connected to a central, main support housing 124 of fluid distribution manifold 53 via a hub 125 (depicted in FIG. 3), while carrier arms 120-123 are rotatably mounted to fluid distribution manifold 53 at a hub 126 of a lower, fluid chamber defining housing 127. Rotating spray arms 110-113 are independently, rotatably mounted at a distal end of carrier arms 120-123 by respective hubs 130-133. In accordance with the invention, this configuration allows for washing fluid distribution throughout washing chamber 14, including corners which are out of reach of typical spray arms.

Figure 3:
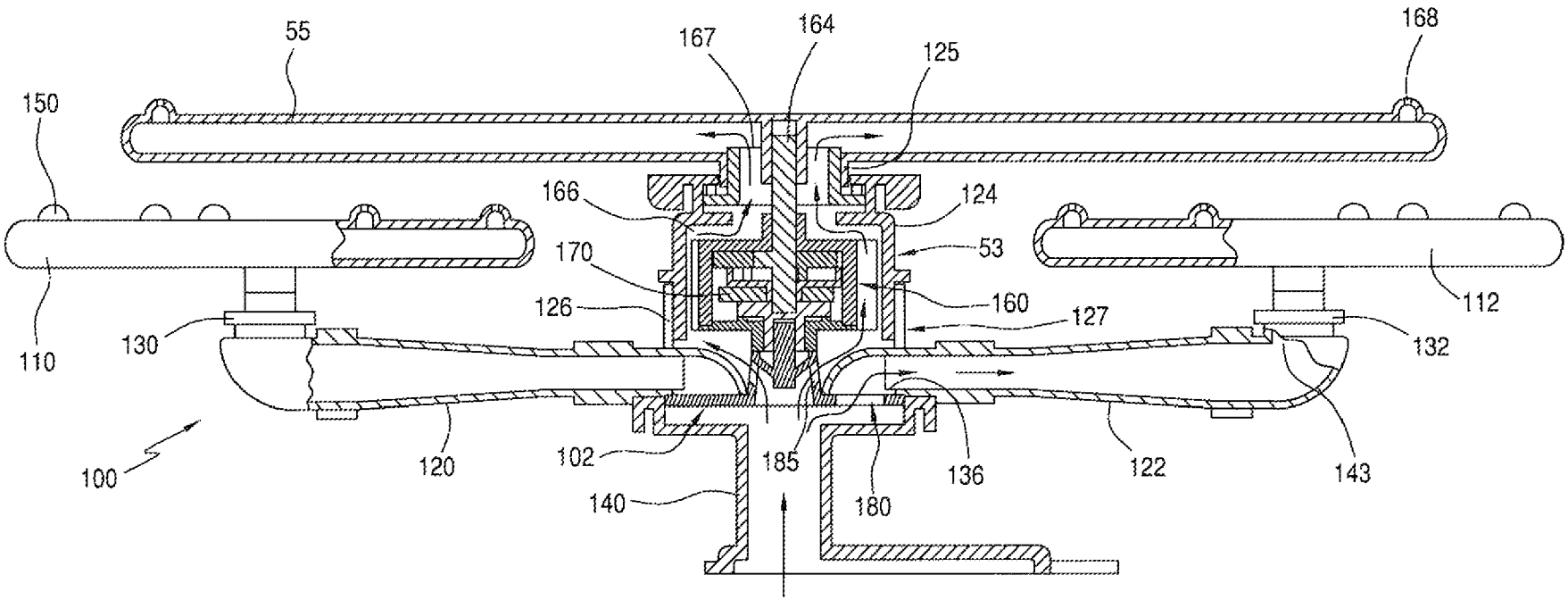
FIG. 3 is a partial cross-sectional side view of the sequencing lower spray arm assembly of FIG. 2.

As best illustrated in FIG. 3, carrier arms 120-123 are hollow and are in fluid communication with lower housing 127 via fluid outlets 136 in lower housing 127. A supply line 140 delivers fluid to housing 127 via a recirculating pump (not shown). Carrier arms 120-123 also include respective outlets 143 in fluid communication with one of the respective rotating spray arms 110-113. A plurality of nozzles 150 are provided on spray arms 110-113 and configured to direct jets of fluid throughout washing chamber 14. At least one nozzle 150 on each spray arm 110-113 directs a jet of fluid in a direction for thrusting the respective spray arm 110-113 to rotate, preferably in a common rotational direction. Spray arms 110-113 are preferably made of plastic and are relatively short in length, thereby being light compared to typical spray arms, such that less energy is needed to rotate spray arms 110-113 during a wash cycle. In one embodiment of the invention, jets of fluid from the at least one nozzle 150 are directed at a relative high acute angle with respect to dishwasher walls 8-11, thereby reducing noise from impinging jets of fluid which would be otherwise directed at a more horizontal or low acute angle to supply a sufficient rotational force to spray arms 110-113. Although depicted as including five nozzles each, spray arms 110-113 may be provided with more or fewer nozzles as desired. In the preferred embodiment shown, spray arms 110-113 operate on the same plane and are sized such that they can rotate freely without interference within washing chamber 14 while just missing each other, side and rear walls 9-11 and door 20. With this configuration spray arms 110-113 provide washing fluid throughout washing chamber 14 so as to provide enhanced spray distribution and better corner washability.

In accordance with the present invention, spray arms 110-113 are driven in a sequential manner utilizing sequencing diverter valve system 102. Advantageously, small sequencing spray arms 110-113 utilizes less water compared to a single large prior art spray arm, with only one or two of arms 110-113 being operated at a given time. Further, by operating only one or two of spray arms 110-113 at a time, water pressure in spray arms 110-113 is increased, while the fluid flow rate through the system is reduced as compared to a conventional spray arm.

Figure 4:
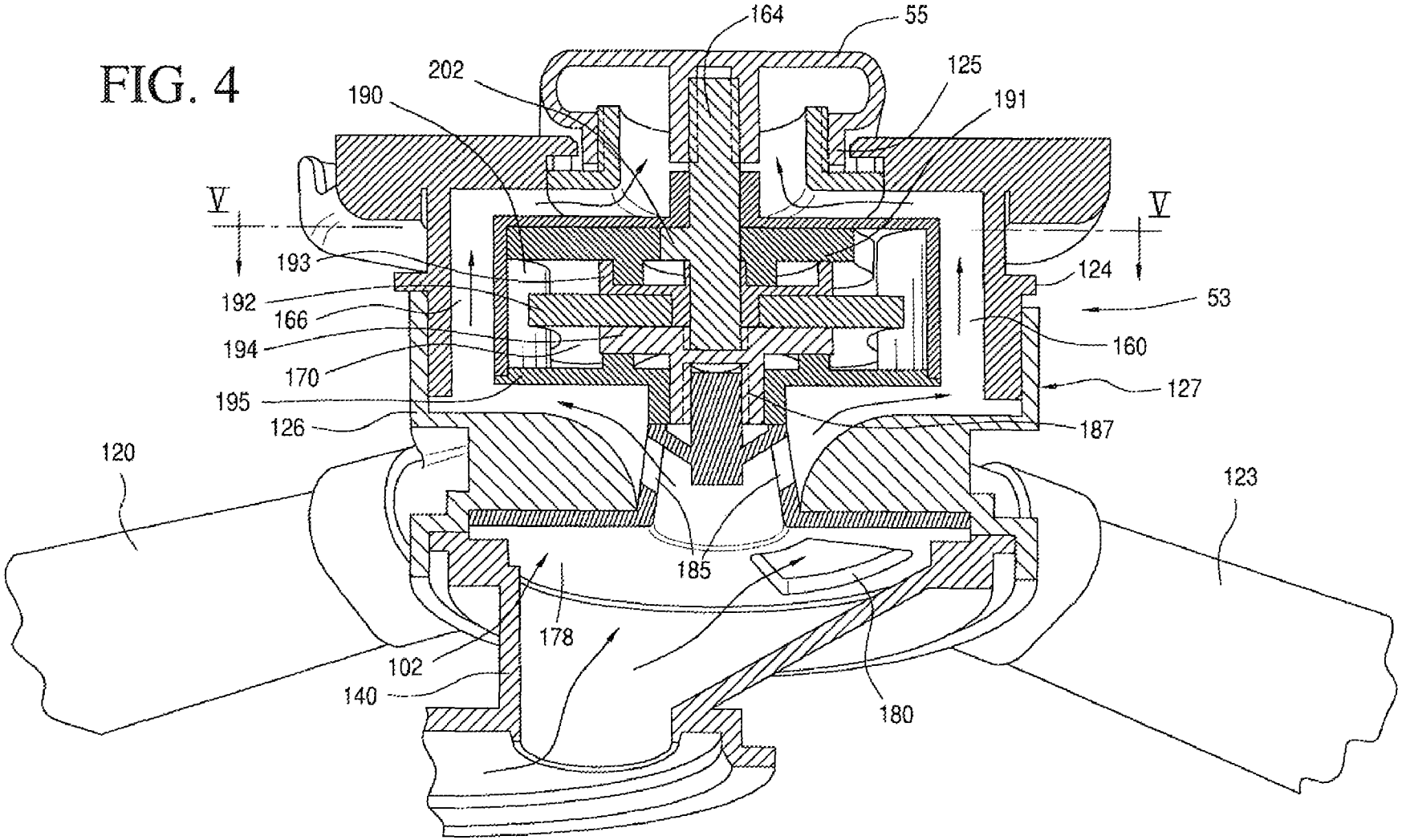
FIG. 4 is a partial cross-sectional perspective view of a sequencing gear train assembly utilized in accordance with the present invention.

Sequencing diverter valve system 102 of the present invention will now be discussed in more detail with reference to FIGS. 3 and 4. Sequencing diverter valve system 102 utilizes a reduction train or sequencing gear assembly 160. In accordance with a novel aspect of the present invention, drive arm 55 is connected to gear assembly 160 housed in fluid distribution manifold 53 by a drive shaft 164. In use, fluid flows upward through an annular channel 166 in fluid distribution manifold 53 through an upper outlet 167 and into drive arm 55. Fluid exits drive arm 55 through at least one nozzle 168 adapted to direct jets of fluid in a direction for driving the rotation of drive arm 55 in a common direction to spray arms 110-113, and causing the concurrent rotation of drive shaft 164. In turn, drive shaft 164 drives an epicyclical gear train 170 of sequencing gear assembly 160. Gear train 170 includes an output shaft 175 connected to a sequencing valve, shown in the form of a disk 178, located between fluid supply line 140 and fluid distribution manifold 53.

Sequencing disk 178 includes at least one opening 180 and, in use, acts as a valve to open and close respective inlets 181-184 (seen best in FIG. 6) in a bottom wall of lower housing 127. Each inlet 181-184 is in communication with a respective carrier arm 120-123. In other words, sequencing disk 178 is adapted to sequentially block multiple ones of the plurality of respective inlets 181-184 to lower housing 127 and thus to sequentially direct fluid through outlets 136 into respective carrier arms 120-123 by rotating sequencing disk 178 through a plurality of discrete rotational positions. Therefore, washing liquid from fluid supply line 140 is directed through one or more ports 180 in sequencing disk 178 into lower housing 127, and through respective outlets 136 into one or more carrier arms 120-123.

At this point, it should be understood that the carrier arm or arms that receive washing liquid from fluid supply line 140 depends on the rotational position of sequencing disk 178. In FIG. 3, for example, sequencing disk 178 is in a first rotational position wherein a fluid stream is directed through port 180 into carrier arm 122 of spray arm 112. In FIG. 4, sequencing disk 178 is in a second rotational position wherein a fluid stream is directed through port 180 into carrier arm 123 of spray arm 113. In this configuration, fluid in spray arm 113 exits nozzles 150 and drives the rotation of spray arm 113. In accordance with the invention, fluid would next be supplied to adjacent carrier arm 120 when sequencing disk 178 is rotated to a third rotational position (not shown). Washing fluid not directed to one or more carrier arms 120-123 is directed through apertures 185 in sequencing disk 178 into channels 166 as secondary fluid streams, and through channels 166 to drive arm 55, wherein drive arm 55 is powered by washing liquid exiting drive arm 55 through nozzles 168.

Gear train 170 allows for a sufficient dwell time of sequencing disk 178 at each rotational position so as to supply sufficient wash fluid to a particular spray arm 110-113 or group of spray arms (e.g., 110 and 112 depending on the number and relative positions of ports 180 provided in disk 178) in a sequential manner. At this point, it should be realized that various different types of gearing reduction driving systems could be employed to establish a desired dwell time based on the rotation of drive arm 55. In the preferred embodiment shown, gear train 170 is a epicyclical gear train which provides for a rotational ratio of 36 to 1 between drive arm 55 and sequencing disk 178. That is, for every thirty six rotations of drive arm 55, gear train 170 will rotate sequencing disk 178 one rotation. However, it should be understood that the dwell time of sequencing disk 178 in each rotational position can be readily altered by altering the gear ratio of gear train 170.

Figure 5:
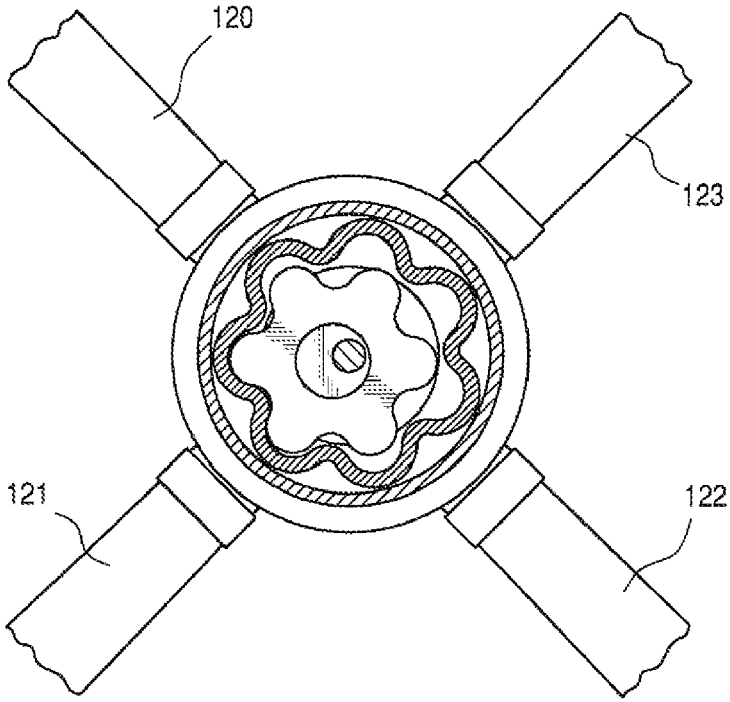
FIG. 5 is a top partial cross-sectional view of the sequencing gear train assembly of FIG. 4.
Figure 6:
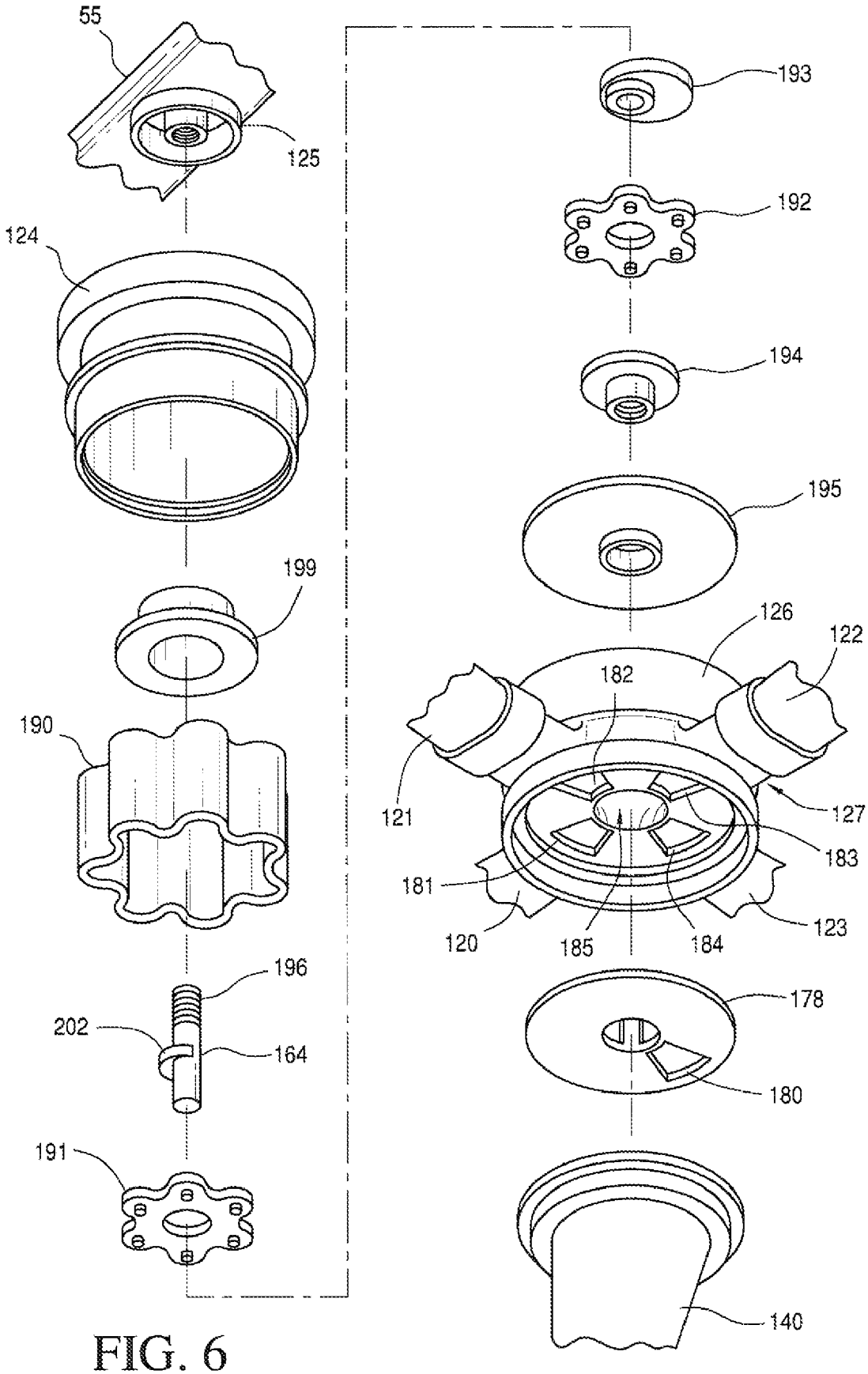
FIG. 6 is an exploded partial perspective view of the sequencing gear train assembly of FIG. 4.

The manner in which gear train 170 connects to sequencing disk 178 and drive arm 55 will now be discussed in more detail with reference to FIGS. 3, 5 and 6. In general, gear train 170 comprises drive shaft 164, a stationary epicyclical gear 190, first and second epicyclical gears 191 and 192, a gear carrier 193 and an output shaft 194 adapted to extend through a lower housing cover 195. As depicted in FIG. 6, first and second epicyclical gears 191 and 192 include pins (not separately labeled) to engage the respective gear carrier 193 and output shaft 194. During assembly, a threaded portion 196 of drive shaft 164 extends through an opening in stationary epicyclical gear 190, an opening in an insert 199 and an opening in main housing 124 to connect to hub 125 of drive arm 55. A drive lever 202 extending from drive shaft 164 is adapted to abut an upper wall of main housing 124 and operatively engage epicyclical gear 191. The remaining components of gear train 170 are retained within main housing 124 by lower housing cover 195. Output shaft 194 extends through a central opening of housing cover 195 and operatively engages sequencing disk 178. As the rotational force of drive arm 55 is transferred through gear assembly 160 to sequencing disk 178, sequencing disk 178 is rotated through multiple rotational positions to allow fluid to sequentially enter respective openings 126 in carrier arms 120-123.

Figure 7:
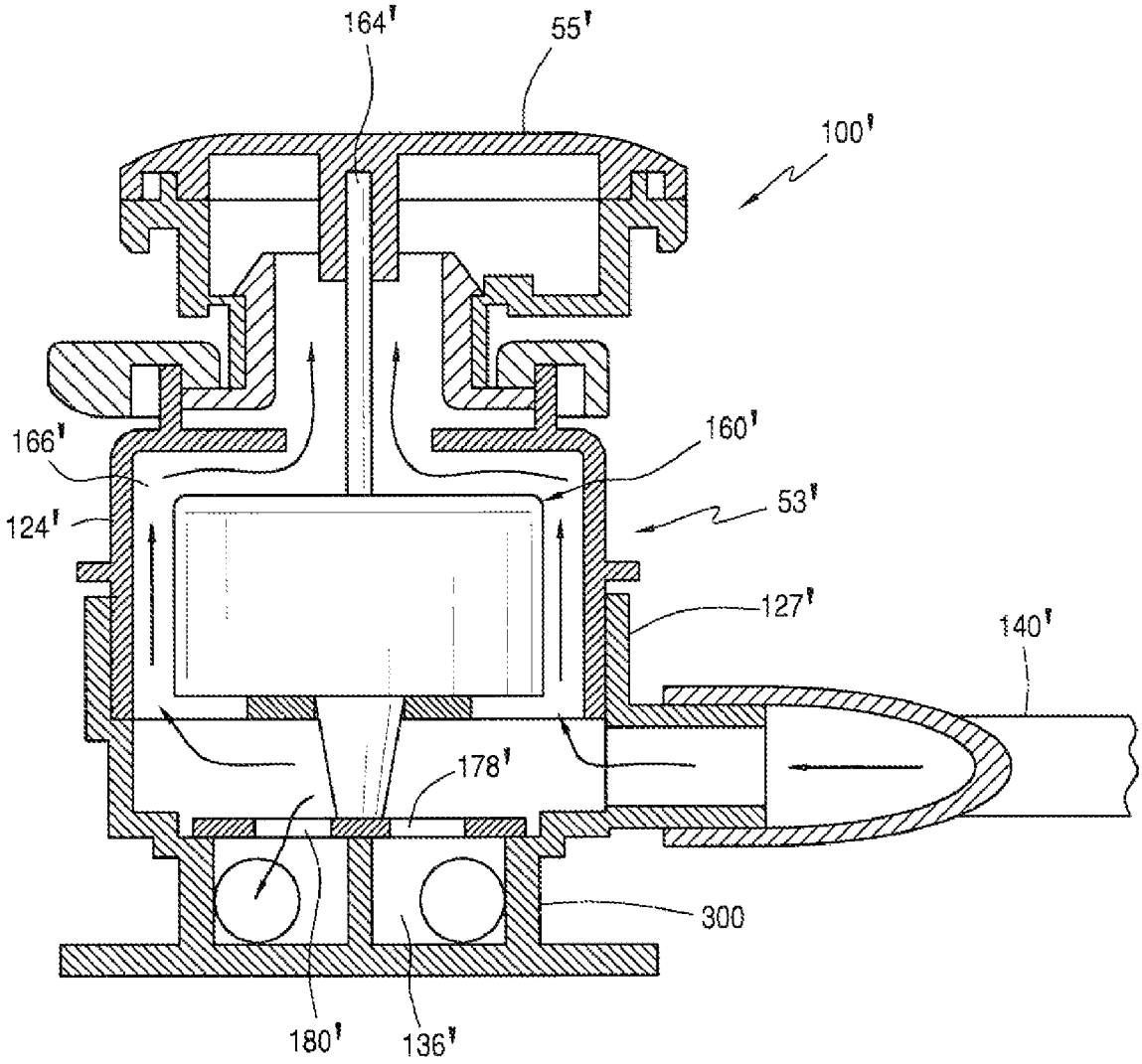
FIG. 7 is a partial cross-sectional perspective view of an alternative embodiment of the sequencing lower spray arm assembly of the present invention.

As should be readily understood from the above description, washing fluid is supplied to sequencing spray arm assembly 100 from below sequencing disk 178. In an alternative embodiment, a sequencing disk 178' having ports 180' is located below a fluid supply line 140'. This alternative spray arm assembly 100' will now be discussed with reference to FIG. 7. As in the previous embodiment, a drive arm 55' is operatively connected to a sequencing gear assembly 160' housed in a fluid distribution manifold 53' by a drive shaft 164'. However, in this alternative arrangement, a lower housing 127' includes a fluid distribution manifold 300 in communication with additional spray arms (not shown) located below fluid supply line 140' and sequencing disk 178'. In the manner discussed above, the rotational force of drive arm 55' is transferred through gear assembly 160' to sequencing disk 178', and sequencing disk 178' is rotated through a sequence of rotational positions to allow fluid to flow through one or more ports 180' in sequencing disk 178'. In this embodiment, each port 180' is connected to a respective lower spray arm (not shown) through lower fluid outlets 136'. As shown, two ports 180' and, thus, two spray arms (not shown), are supplied with fluid for each rotational position of sequencing disk 178'. Washing fluid not directed to lower housing 127' flows into channel 166' defined within a housing 124' as secondary fluid streams, and through channel 166' to drive arm 55', wherein drive arm 55' is powered by washing liquid exiting drive arm 55' and functions to rotate drive shaft 164'.

Advantageously, the present system provides extended reach of washing fluid into the corners of the dishwasher, resulting in more flexible dish loading options and better corner washability. Additionally, sequencing of the lower arms allows for the potential to reduce the fill amount and to save energy. The reduced flow rate through the small arms results in less fluid noise. Further, the nozzles on the small arm ends may be angled in a more vertical direction, minimizing sound generated by fluid impacting the sides of the dishwasher tub. Pressure increases in each individual small arm, resulting in reduced flow rate and increased pressure over a conventional spray arm. The result is a system having improved wash performance through increased wash intensity and improved coverage.

Although described with reference to a preferred embodiment of the invention, it should be readily understood that various changes and/or modifications can be made to the invention without departing from the spirit thereof. For instance, although shown in use with a sequencing spray arm assembly 100, it should be understood that the sequencing diverter valve system of the present invention may be utilized to sequentially divert washing fluid to any desired combination of fluid outlets, such as spray manifold assembly 59 and an upper spray assembly (not shown) fed by conduit 57. In addition, the invention is applicable to other washing appliances which would potentially benefit from a sequenced fluid distribution system. Furthermore, although an epicyclical drive train is employed in the preferred embodiment disclosed, other reduction drive mechanisms could also be employed. In general, the invention is only intended to be limited by the scope of the following claims.

What is claimed is:

1. A washing appliance comprising:

a tub defining a washing chamber for receiving articles to be washed;

a door attached to the tub for selectively closing the washing chamber;

a supply line for providing a washing fluid; and a sequencing diverter valve system comprising:

a fluid distribution manifold including a housing having at least one fluid inlet connected to the fluid supply line and a plurality of fluid outlets;

a drive member rotatably mounted in the tub;

a sequencing valve provided in the housing and movable between at least first and second positions wherein, in the first position, the sequencing valve directs washing fluid to one of the plurality of fluid outlets and, in the second position, the sequencing valve directs washing fluid to another one of the plurality of fluid outlets; and a reduction drive mechanism connected between the drive member and the sequencing valve, wherein rotation of the drive member causes shifting of the sequencing valve between the first and second positions through the reduction drive mechanism.

2. The washing appliance according to claim 1, wherein the reduction drive mechanism constitutes a gear train.

3. The washing appliance according to claim 2, wherein the gear train is contained within the housing.

4. The washing appliance according to claim 2, wherein the gear train is an epicyclical gear reduction train.

5. The washing appliance according to claim 4, wherein the epicyclical gear reduction train is configured to provide for multiple rotations of the drive member before the sequencing valve is shifted between the first and second positions.

6. The washing appliance according to claim 2, wherein the sequencing valve is rotatably supported and directly connected to the gear train.

7. The washing appliance according to claim 6, wherein the drive member and the sequencing valve are rotated at a ratio in the order of 36:1.

8. The washing appliance according to claim 1, wherein the sequencing valve includes four sequencing ports.

9. The washing appliance according to claim 1, wherein the sequencing valve is in the form of a rotatable disk.

10. The washing appliance according to claim 1, wherein the washing appliance constitutes a dishwasher.

11. The washing appliance according to claim 10, wherein the drive member constitutes a wash arm which is rotated based on fluid supplied through the fluid distribution manifold.

12. The washing appliance according to claim 11, wherein the sequencing valve provides for delivery of washing fluid from the fluid distribution manifold to one spray unit mounted in the tub when the sequencing valve is in the first position and provides delivery of washing fluid from the fluid distribution manifold to another spray unit mounted in the tub when the sequencing valve is in the second position.

13. The washing appliance according to claim 1, wherein the at least one fluid inlet of the fluid distribution manifold is arranged below the sequencing valve.

14. The washing appliance according to claim 1, wherein the at least one fluid inlet of the fluid distribution manifold is arranged above the sequencing valve.

15. A method of controlling fluid distribution in an appliance including a washing chamber comprising:

supplying washing fluid to a fluid distribution manifold including a housing and having a plurality of fluid outlets;

rotating a drive member;

driving a reduction drive mechanism based on rotation of the drive member; and shifting a sequencing valve, provided in the housing and connected to the reduction drive mechanism, between at least first and second discrete positions to sequentially direct washing fluid to respective ones of the plurality of fluid outlets.

16. The method of claim 15, further comprising:

rotating the drive member based on fluid supplied through the fluid distribution manifold.

17. The method of claim 16, further comprising:

supplying fluid to the drive member to cause rotation of the reduction drive mechanism and the sequencing valve, with the drive member and the sequencing valve being rotated at a ratio in the order of 36:1.

18. The method of claim 16, wherein the washing appliance constitutes a dishwasher and the drive member constitutes a wash arm rotated based on fluid supplied through the fluid distribution manifold, and wherein the sequencing valve provides for delivery of washing fluid from the fluid distribution manifold to one spray unit mounted in the washing chamber when the sequencing valve is in the first position and provides delivery of washing fluid from the fluid distribution manifold to another spray unit mounted in the washing chamber when the sequencing valve is in the second position.

19. The method of claim 15, further comprising: supplying the washing fluid to the fluid distribution manifold at a position below the sequencing valve.

20. The method of claim 15, further comprising: supplying the washing fluid to the fluid distribution manifold at a position above the sequencing valve.

* * * * *